United States Patent [19]

Nicholls

[11] 4,179,690

[45] Dec. 18, 1979

[54] TWO-TONE AUDIBLE WARNING CIRCUITS

[75] Inventor: Mark S. Nicholls, Northampton, England

[73] Assignee: The Mettoy Company Limited, Northampton, England

[21] Appl. No.: 838,832

[22] Filed: Oct. 3, 1977

[30] Foreign Application Priority Data

Oct. 7, 1976 [GB] United Kingdom ..... 41831/76

[51] Int. Cl.[2] ..... G08B 3/10

[52] U.S. Cl. ..... 340/384 E; 340/384 E

[58] Field of Search ..... 340/384 E; 331/108 D

[56] References Cited

U.S. PATENT DOCUMENTS

| | | | |
|---|---|---|---|
| 3,634,781 | 1/1972 | Hammelehle | 331/108 D |
| 3,801,866 | 4/1974 | Schmidgall | 331/108 D |
| 3,875,527 | 4/1975 | Garcia | 331/108 D |
| 3,878,482 | 4/1975 | Schowe | 331/108 D |
| 3,916,345 | 10/1975 | Eberlein | 331/108 D |

*Primary Examiner*—Harold I. Pitts

*Attorney, Agent, or Firm*—Watson, Cole, Grindle & Watson

[57] ABSTRACT

In a circuit for producing an audible signal, a sounder is connected to an audio frequency signal generator circuit for producing the audible signal. A modulator circuit is connected to the signal generator circuit for controlling it to alter the frequency of the operation thereof. The signal generator circuit and the modulator circuit each comprise two inverters connected in series with a resistor connected in parallel with one of the two inverters. A capacitor is connected in parallel with the series combination of the two inverters and all of the inverters are formed on a single integrated circuit package.

10 Claims, 2 Drawing Figures

TWO-TONE AUDIBLE WARNING CIRCUITS

BACKGROUND

1. Field of the Invention

The present invention relates to toys, in the nature of miniatures of public service vehicles, such as miniatures of ambulances, police cars, fire engines and the like. In particular, the present invention relates to circuits for producing a two-tone audible warning for use with such toys.

2. Prior Art

The audible warning at present used on public service vehicles such as police cars and the like, consists of a two-tone signal, switched between the two tones at approximately half-second intervals. Our U.K. Pat. No. 1,411,752 relates to circuits which can be used for providing such a warning in toys. However, these have not proved completely satisfactory for all sizes of toys in that they tend to be bulky and sometimes cannot be accomodated within smaller toys. Attempts have been made to utilize integrated circuit packages but these have primarily required two integrated circuit packages. While for some toys, this is satisfactory it still does not result in a sufficiently compact arrangement, nor is it inexpensive.

SUMMARY OF THE INVENTION

The present invention provides a circuit for producing an audible signal, comprising an audio frequency signal generator and a modulator connected to the signal generator for controlling the frequency of operation of the signal generator, the signal generator and the modulator being provided using a single integrated circuit.

Preferably, the integrated circuit package comprises six inverters, two of which are connected to provide an audio frequency oscillator and the other two of which are connected to provide a modulator for controlling the oscillator to produce a two-tone signal. The remaining two are used as buffers.

BRIEF DESCRIPTION OF THE FIGURES

Features and advantages of the present invention will appear from the following description of embodiments thereof given by way of example, in conjunction with the accompanying drawings, in which.

DETAILED DESCRIPTION

Figure 1:
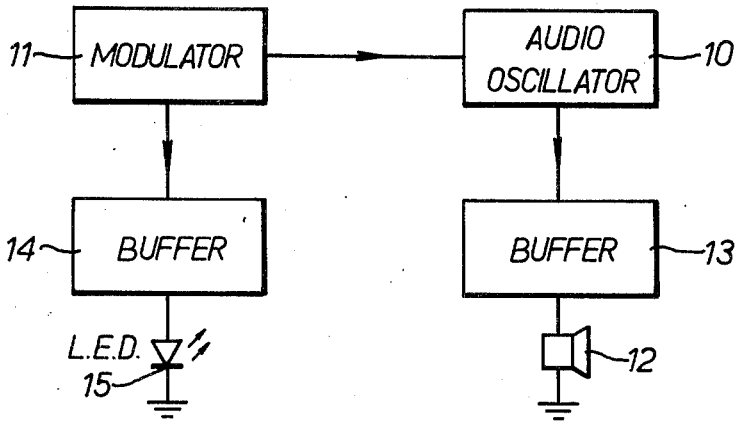
FIG. 1 is a block diagram of a circuit according to the present invention.

Turning now to the drawing, FIG. 1 shows a block diagram of the preferred circuit arrangement. An audio frequency oscillator 10 is driven by a modulator or driving oscillator 11 so as to produce output signals at two different frequencies. These output signals are fed to a sounder 12 via a buffer 13 so as to produce the two tone signal. If desired, a flashing visual indication can also be given by feeding the output from the driving oscillator 11 through a further buffer 14 to a light emitting device 15.

Figure 2:
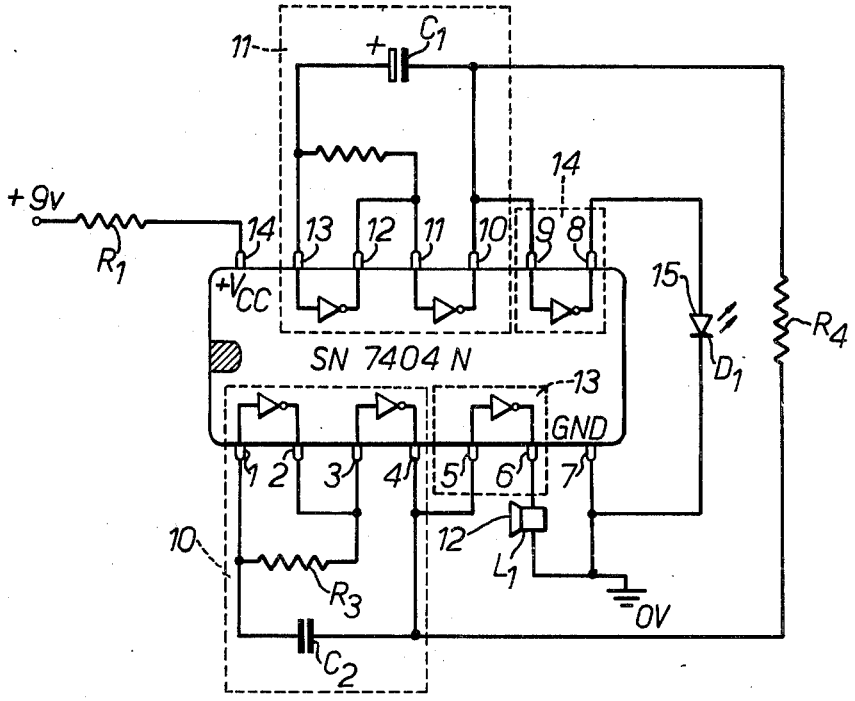
FIG. 2 is a circuit diagram of the circuit shown in FIG. 1.

A more detailed circuit is shown in FIG. 2. In this case two oscillators are provided using, as a basis, an integrated circuit package of the hex-inverter type manufactured by Texas Instruments and sold under the code SN7404N. The various blocks and components mentioned in relation to FIG. 1 are identified by the same reference numerals in FIG. 2.

The circuit shown in FIG. 2 is powered by a 9 volt battery and this is dropped to approximately 5 volts using resistor $R_1$. It will be noted that the above circuit uses an inexpensive TTL package in an essentially linear application. It has previously been thought that this was only possible with expensive C-MOS integrated circuits. However, it has been found that the above circuit will produce stable oscillators and it is thought that this is due to the utilisation of hysteresis at each gate input, and also the high gain between input and output when operating in the linear mode.

It has also been found that the value of the resistor $R_4$ which couples the output of the driving oscillator to the audio frequency oscillator 10 has many secondary effects; for example on audio pitch and modulation frequency. In its absence, neither the audio oscillator nor the driving oscillator will function, but when included the operation of both oscillators is stable, reliable, and insensitive to errors in component values of the order of ±20%.

Table 1 given below sets out suitable component values on the basis of a sounder 12 of impedance 130Ω and a light emitting diode 15, when included, rated at 1.5 v @ approximately 20 mA.

| | $R_1$ (Ω) | $R_2$ (Ω) | $R_3$ (Ω) | $R_4$ (Ω) | electrolytic $C_1$ (μF) | disc ceramic $C_2$ (μF) |
|---|---|---|---|---|---|---|
| Without L.E.D. | 100 | 1K | 1K | 470 | 500 | 0.47 |
| With L.E.D. | 82 | 1K | 820 | 220 | 500 | 0.47 |
| | | | USING SN 74L04N | | | |
| Without L.E.D. | 220 | 3K3 | 820 | 1K | 125 | 0.22 |
| With L.E.D. | 220 | 3K3 | 820 | 1K5 | 125 | 0.22 |

The two oscillators are identical save for the frequency of oscillation which is determined by the values of R and C used. Therefore, only the operation of the modulator 11 will be described in detail with reference to FIG. 2.

Initially, the capacitor $C_1$ is unchanged therefore a logic 0 will exist at pins 10 and 13 of the integrated circuit package. By operation of the inverter connected across pins 13 and 12, a logic 1 will exist at pin 12 and by operation of the other inverter the pin 10 will be held at a logic 0.

A potential difference across $R_1$ due to the different logic levels on pins 13 and 12 causes current to flow and the capacitor 12 charges until pin 13 reaches transfer voltage $V_1$. This causes the first inverter to change state with pin 12 moving to logic level 0 and hence, via the other inverter pin 10 moves to logic level 1. This occurs in a time which is so short that the pin 13 is still at level $V_1$. However, the potential difference across resistor $R_1$ causes the capacitor $C_1$ to discharge and head pin 13 falls toward level 0 until it reaches transfer voltage $V_2$ ($<V_1$ due to hysteresis). Both inverters change state again and the cycle repeats with the potential on pin 13 varying between $V_1$ and $V_2$.

The above circuits occupy little space are robust and inexpensive to manufacture. The frequency of oscillation of each of the oscillators is dependent on the difference between the transfer voltages of the gate input, and this varies minimally between different integrated circuit packages (although the absolute values may vary considerably). Thus, the frequency of operation remains remarkably constant while using different samples of packages.

What is claimed is:

1. A circuit for producing an audible signal, comprising:

a sounder connected to an audio frequency signal generator circuit for producing the audible signal;

a modulator circuit connected to the signal generator circuit for controlling the signal generator circuit to alter the frequency of operation thereof;

said signal generating circuit and said modulator circuit each comprises two inverters connected in series with a resistor connected in parallel with one of the two inverters; and a capacitor connected in parallel with the series combination of the two inverters, all said inverters being provided on a single integrated circuit package.

2. A circuit according to claim 1, wherein said modulator is connected to the signal generator circuit by a resistor.

3. A circuit according to claim 1, and further comprising means for producing a flashing visual indication.

4. A circuit according to claim 3, wherein the flashing visual indicating means comprises a light emitting diode connected to the output from the modulator circuit.

5. A circuit for producing an audible signal in a toy vehicle, comprising:

a sounder connected to an audio frequency signal generator circuit for producing the audible signal;

a modulator circuit connected to the signal generator circuit for controlling the signal generator circuit to alter the frequency of operation thereof;

said signal generating circuit and said modulator circuit each comprises two inverters connected in series with a resistor connected in parallel with one of the two inverters; and a capacitor connected in parallel with the series combination of the two inverters, all said inverters being provided on a single integrated circuit package.

6. A circuit according to claim 5, wherein the single integrated circuit package is a digital integrated circuit package.

7. A circuit according to claim 5, wherein the integrated circuit package is a transistor-transistor logic integrated circuit package.

8. A circuit according to claim 5, wherein said modulator is connected to the signal generator circuit by a resistor.

9. A circuit according to claim 5, and further comprising means for producing a flashing visual indication.

10. A circuit according to claim 9, wherein the flashing visual indicating means comprises a light emitting diode connected to the output from the modulator circuit.

* * * * *